United States Patent [19]

Nihyakumen et al.

[11] 3,976,488

[45] Aug. 24, 1976

[54] TREATING AGENT FOR DIAZO-TYPE MULTICOLOR REPRODUCTION

[75] Inventors: Kouzi Nihyakumen, Hirakata; Taizo Yokoyama, Osaka; Yasuo Ueda, Kobe; Yasutoki Kamezawa; Tatsuo Aizawa, both of Osaka, all of Japan

[73] Assignee: Mita Industrial Company, Ltd., Osaka, Japan

[22] Filed: Dec. 16, 1974

[21] Appl. No.: 533,257

Related U.S. Application Data

[63] Continuation of Ser. No. 308,306, Nov. 20, 1972, abandoned, which is a continuation-in-part of Ser. No. 12,049, Feb. 17, 1970, Pat. No. 3,715,213.

[30] Foreign Application Priority Data

| | | |
|---|---|---|
| Feb. 19, 1969 | Japan | 44-11914 |
| Aug. 22, 1969 | Japan | 44-65980 |
| Nov. 18, 1969 | Japan | 44-91964 |

[52] U.S. Cl. ..... 96/49; 96/75; 106/19; 427/261; 427/264; 250/317; 250/318

[51] Int. Cl.[2] ..... G03C 5/34

[58] Field of Search ..... 96/49.75, 91 R; 106/19; 427/261, 264; 250/317, 318

[56] References Cited

UNITED STATES PATENTS

| | | | |
|---|---|---|---|
| 2,113,193 | 4/1938 | De Boer | 96/49 |
| 2,209,087 | 7/1940 | Leuch | 96/49 |
| 2,239,704 | 4/1941 | De Boer et al. | 96/49 |
| 2,425,804 | 8/1947 | Hossenlopp | 106/19 |
| 2,559,398 | 7/1951 | Capell | 106/19 |
| 2,789,904 | 4/1957 | Benbrook et al. | 96/49 |
| 3,203,797 | 8/1965 | Muller | 96/49 |
| 3,353,984 | 11/1967 | Landau | 96/75 |
| 3,454,764 | 7/1969 | Collier et al. | 96/49 |
| 3,510,336 | 5/1970 | Figov | 96/49 |
| 3,520,691 | 7/1970 | Scheler et al. | 96/49 |
| 3,627,546 | 12/1971 | Coppeta | 106/19 |

FOREIGN PATENTS OR APPLICATIONS

| | | | |
|---|---|---|---|
| 6,702,099 | 8/1967 | Netherlands | 96/49 |
| 1,169,745 | 11/1969 | United Kingdom | 96/49 |
| 815,005 | 12/1966 | United Kingdom | 96/75 |

*Primary Examiner*—Charles L. Bowers, Jr.
*Attorney, Agent, or Firm*—Sherman & Shalloway

[57] ABSTRACT

An original-treating agent to be used in the process for the diazo-type multi-color reproduction by which portions of a sensitive paper corresponding to preselected portions of an original can be colored selectively in different hues.

7 Claims, 11 Drawing Figures

TREATING AGENT FOR DIAZO-TYPE MULTICOLOR REPRODUCTION

Figure 1:
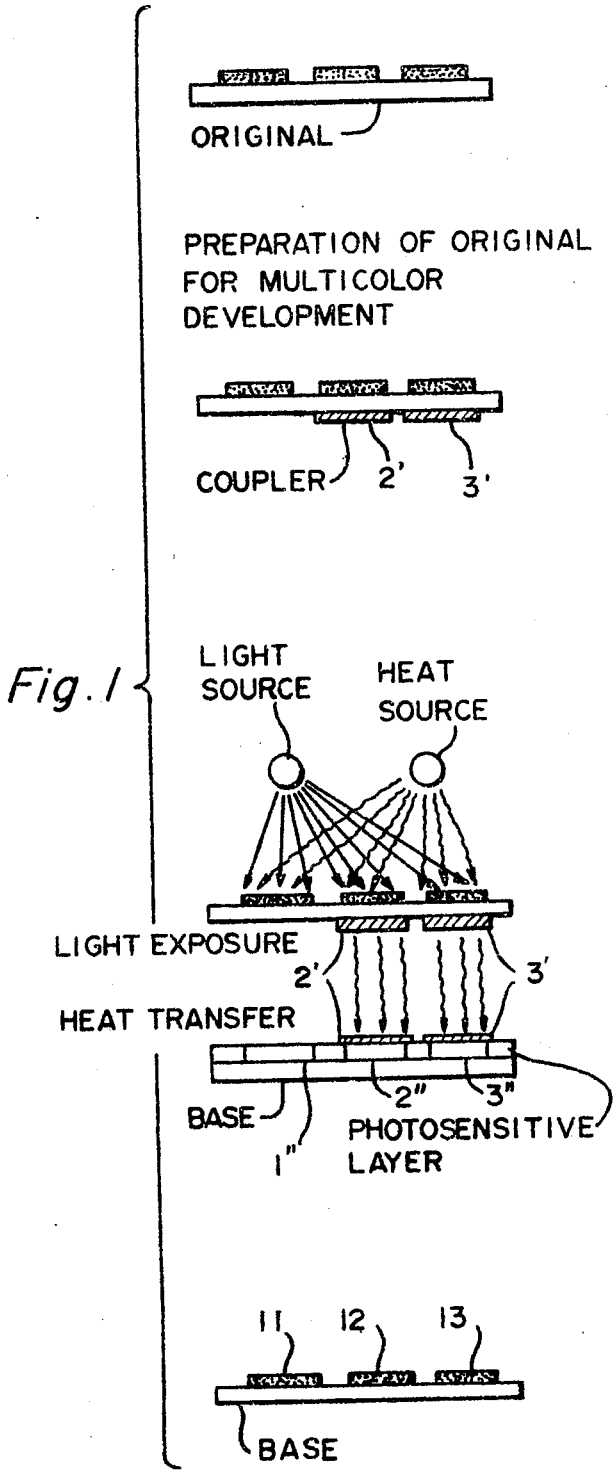

This application is a continuation of application Ser. No. 308,306 filed Nov. 20, 1972 now abandoned, which is a continuation-in-part application of our copending application Ser. No. 12,049 filed on Feb. 17, 1970, now U.S. Pat. No. 3,715,213.

This invention relates to the diazo-type multi-color reproduction. More particularly, the invention relates to an original-treating agent to be used in the process for the diazo-type multi-color reproduction by which portions of a sensitive paper corresponding to preselected portions of an original can be colored selectively in different hues.

It has heretofore been known that when two or more diazonium salts which have different resolving rates and exhibit different hues upon bonding with couplers are used in the diazo-type reproduction, reproductive copies can be obtained which are colored in two or more hues depending on the intensity of light on the exposed portions. In such reproductive copies, image colors of the semi-exposed portions are mingled with image colors of non-exposed portions to form a compound color, and the color contrast in the image becomes faded. Further, in such known reproduction process it is impossible to reproduce an original having a similar image concentration or light transmission throughout the entire original, into different hues.

No diazo-type reproduction process has been known by which predetermined portions of an original can be reproduced into hues different from one another regardless of difference or similarity of the light transmission in the original.

We have disclosed in our copending application Ser. No. 12,049 filed on Feb. 17, 1970 a diazo-type multicolor reproduction process in which preselected portions of an original can be reproduced into different hues regardless of the difference or similarity of the light transmission in the original by conducting the steps of (A) exposing to light a diazo-type photosensitive material containing at least one diazonium salt and (B) heating a layer of at least one thermovolatile or thermosublimable azo coupler (a) disposed in face-to-face contact with a predetermined portion of the diazo-type photosensitive material, said steps being carried out coincidentally or in an order of (A) to (B) or (B) to (A), and then developing the exposed photosensitive material in the presence of an azo coupler (b) having a lower coupling rate under developing conditions than the said thermovolatile or thermosublimable coupler (a).

It is essential that among the thermovolatile or thermosublimable coupler (a), coupler (b) and diazonium salt (c) used in the process mentioned above, there should be established the following relations:

I. Thermovolatile or thermosublimable coupler (a) has a higher coupling rate under developing conditions than coupler (b).

II. Dyestuff (b)–(c), dyestuff (a)–(c), dyestuff (a')–(c) . . . formed at the development have hues different from one another.

Any coupler that can be volatilized or sublimated by heating and be coupled with a photosensitive diazonium salt may be used as the thermovolatile or thermosublimable coupler (a) in this process. As such coupler (a), phenol derivatives, hydroxynaphthalene derivatives, aniline derivatives and active methylene group-containing compounds may be mentioned. It is generally preferred that these derivatives do not contain soluble groups such as a sulfonic acid group for the purpose of facilitating the heat transfer operation.

The volatilization or sublimation temperature of the coupler (a) is not particularly critical, but it is generally preferred that the coupler (a) volatilizes or sublimates at a temperature below 200°C., especially below 180°C. However, if the volatilization or sublimation temperature is too low, such disadvantages as poor fastness of the dye formed by the coupling reaction of the diazonium salt and coupler (a) are brought about. Therefore, it is preferred that the coupler (a) has a volatilization or sublimation temperature exceeding room temperature.

Examples of these derivatives usable as coupler (a) are as follows:

Phenol Derivatives
Phenol
Pyrocatechol
Resorcinol
Phloroglycinol
o-Hydroxybenzalcohol
Resorcin monoglycol ether
4-Bromo-resorcinol
4-Chloro-resorcinol
Pyrogallol
Resorcinol glycol ether
Hydrotoluquinone
Pyrogallol-4-carboxylic acid
Vanillin
Isovanillic acid
Vanillic acid
5-Hydroxy-isophthalic acid
2-Hydroxy-terephthalic acid
2-Hydroxy-p-toluylic acid
3-Hydroxy-p-toluylic acid
5-Hydroxy-o-toluylic acid
6-Hydroxy-m-toluylic acid
5-Hydroxy-1-naphthalic acid
Para-hydroxyphenylacetic acid
Para-hydroxybenzaldehyde
Ortho-hydroxybenzoic acid
Ortho-hydroxybenzyl alcohol
4,4-Dihydroxybiphenol
3,5-Dichloro-salicylic acid
5-Chloro-2-nitrophenol
2,5-Dihydroxyacetophenone
2,5-Dinitrophenol
2,4-Dinitrophenol
2,4-Dinitroresorcinol
4,6-Dibromo-2-nitrophenol
2,5-Dimethyl hydroquinone Hydroxynaphthalene Derivatives
2,3-Dihydroxynaphthalene
β-Naphthol
α-Naphthol
1,6-Dihydroxynaphthalene
2,6-Dihydroxynaphthalene
1,7-Dihydroxynaphthalene
8-Amino-2-naphthol
2,2'-Dihydroxy-1,1'-binaphthyl
4,4'-Dihydroxy-1,1'-binaphthyl
3-Carboxy-2-naphthol

Aniline Derivatives
Meta-aminobenzoic acid
Meta-aminophenol

2-Amino-p-cresol
Dimethyl-m-aminophenol
Ortho-aminophenol
Para-aminophenol
Para-chloroaniline
3,4-Diaminotoluene

Active Methylene Group-Containing Compounds

1-Phenyl-3-methylpyrazolone (5)
1-(3'-Cholorphenyl)-3-methylpyrazolone
1-Phenyl-3-carboxypyrazolone
1-(p-Toluyl)-3-methylpyrazolone
Acetoacetic acid anilide
5-Hydroxy-2-hydroxymethyl-γ-pyrone
Acetoacetic-o-chloroanilide Compounds exemplified above as coupler (a) may be used singly or in the form of mixtures of two or more of them. In case two or more of these compounds are used in combination, a mixed color composed of colors of dyes formed by the coupling reaction of the diazonium salt with each of such couplers is obtained. Among specific examples mentioned above, the following compounds are especially preferable as coupler (a). The hue of the dye formed by the coupling reaction between the coupler (a) and the diazonium salt (c) varies to some extent depending on the pH conditions, the kind of the diazonium salt and other factors. Therefore, with respect to each preferred coupler (a) listed below, the hue range is described in the parenthesized portion for reference.

| | |
|---|---|
| Pyrogallol | [yellow - red] |
| Resorcin | [yellow - red] |
| Resorcin monoglycol ether | [yellow - red] |
| 2,3-Dihydroxynaphthalene | [blue - reddish violet] |
| 1,6-Dihydroxynaphthalene | [blue - pink (violet)] |
| 1,7-Dihydroxynaphthalene | [blue - reddish violet] |
| 2,7-Dihydroxynaphthalene | [blue - reddish violet] |
| Meta-aminophenol | [yellow - red] |
| Dimethyl-m-aminophenol | [yellow - red] |
| 1-Phenyl-3-methylpyrozolone (5) | [yellow orange - red] |
| 1-Phenyl-3-carboxypyrazolone | [yellow orange - red] |
| Acetoacetic acid anilide | [yellow - orange] |
| 5-Hydroxy-2-hydroxymethyl-γ-pyrone | [blue - bluish violet] |
| 1-(3'-chlorophenyl)-3-methylpyrazolone (5) | [red - reddish orange] |
| 1-(p-Toluyl)-3-methylpyrazolone (5) | [red - reddish orange] |
| 4-Chloro-resorcin | [yellow - yellowish brown] |
| 4-Bromo-resorcin | [yellow - yellowish brown] |
| o-Amino-phenol | [yellow - yellowish brown] |

In conducting the process, at first an original sheet for multi-color development is formed by applying at least one transparent or semi-transparent layer containing a theromvolatile or thermosublimable coupler (a) onto the surface of one or more predetermined portions of a transparent or semitransparent original sheet.

In this case, said original sheet can have opaque image areas on at least one surface thereof, namely on one or both surfaces thereof. The layer containing a thermovolatile or thermosublimable coupler (a) can be applied only on one surface of the original sheet. In case the orginal sheet has opaque image areas only on one surface thereof, the layer containing the coupler (a) is located only on the surface of a preselected image area among such image areas or on the area contiguous with a preselected image area on the opposite surface. Further, in case the original sheet has opaque image areas on both surfaces, the layer containing the coupler (a) is located only on preselected areas which are either or both the image areas on one surface of the original and areas contiguous with the image areas on the opposite surface of the original. In the present specification, the surface to which the layer containing a thermovolatile or thermosublimable coupler (a) is referred to as "coupler-applied surface".

The above-mentioned original sheet for multi-color development may be prepared, for instance, by a method comprising applying a coating composition containing the abovementioned thermovolatile or thermosublimable coupler (a) onto the coupler-applying surface of a portion predetermined to have a different hue, of a transparent or semi-transparent original sheet.

A coating composition for treating the coupler-applied surface of an original sheet and forming a layer for heat-transferring the coupler (a) can be easily prepared by dispersing a coupler (a) into a liquid, semi-solid or solid dispersion medium.

Such treating agent will be now described by referring to some embodiments (the percent being on the weight basis).

1. Ink-like composition for treating the coupler-applied surface of an original (parenthesized range being a preferable range)

| | | |
|---|---|---|
| Coupler (a) | 2.0 – 50.0 % | (10.0 – 30.0 %) |
| Coloring material | 0 – 3.0 % | ( 0 – 0.2 %) |
| Binder | 0 – 10.0 % | ( 0 – 5.0 %) |
| Dispersion assistant | 0 – 5.0 % | ( 0 – 2.0 %) |
| Liquid dispersion medium | balance | |

These components are mixed and the mixture is agitated sufficiently to obtain a homogeneous ink composition. The resulting composition is charged in a suitable vessel, or is impregnated into a felt of an installed felt pen or stamp pad, or a fibrous cloth or porous substance such as a type-writer ribbon.

As the liquid dispersion medium, optional liquids that can disperse or dissolve the coupler (a) therein can be used and readily volatile liquids are preferably used. Examples of liquids preferably used as the liquid dispersion medium include water and various organic solvents such as alcohols, e.g., methanol, ethanol, n-propanol, iso-propanol, n-butanol and amyl alcohol; ketones, e.g., acetone and methylethylketone; aromatic hydrocarbons, e.g., benzene, toluene and xylene; esters, e.g., ethyl acetate and butyl acetate; halogenated hydrocarbons, e.g., carbon tetrachloride, chloroform, trichloroethane and perchloroethylene; and polyhydric alcohols, e.g., ethyleneglycol, propyleneglycol, diethyleneglycol and other glycols. These compounds may be used singly or in the form of mixtures of two or more of them. Lower alcohols are used especially preferably as the liquid dispersion medium in this invention.

It is possible to incorporate a coloring material so as to confirm the formation of a film of the treating agent, or to use a binder for the purpose of obtaining a good fixation of the coupler.

Disperse dyes, especially oil colors, triphenylmethane dyes and stilbene dyes are preferably used as such coloring material. Various synthetic and natural resins can be used as the binder. For instance, acetate resins, styrene resins, vinyl resins, vinylidene resins, etherified urea resins, modified or unmodified alkyd resins, acetal resins and rosin can be used conveniently. More specifically, preferable examples of the resin to be used as the binder include acetate resins such as ethyl cellulose, acetyl cellulose propionate, nitro cellulose, triacetate and diacetate; styrene resins such as acrylonitrile-styrene copolymers, styrene-maleic acid copolymers and styrenebutylene copolymers; vinyl resins such as polyvinyl acetate and polyvinyl chloride; vinylidene resins such as polyvinylidene chloride; etherified urea resins such as butylated urea resins and ethylated urea resins; modified and unmodified alkyd resins such as linseed oil modified alkyd resins, soybean oil modified alkyd resins and unmodified alkyl resins; acetal resins such as polyvinyl acetal; and rosin.

In order to increase the dispersibility into the medium, it is possible to add a dispersion assistant to the composition. Commercially available surface active agents such as anionic, cationic and nonionic surfactants are used as the dispersion assistant.

The composition of the above recipe is applied to the coupler-applied surface of a portion predetermined to have a different hue by means of a brush, a pen, an installed felt pen, a stamp, a coating roller, a sprayer or a printing machine.

2. Pasty composition for treating the coupler-applied surface of an original (the parenthesized range being a preferable range):

| | | |
|---|---|---|
| Coupler (a) | 2.0 – 50.0 % | (10.0 – 30.0 %) |
| Coloring material | 0 – 20.0 % | ( 0 – 10.0 %) |
| Binder | 0 – 15.0 % | ( 0 – 10.0 %) |
| Organic solvent | 0 – 15.0 % | ( 0 – 10.0 %) |
| Oily dispersion medium | balance | |

These components are placed into a ball mill and they are kneaded for 2 – 3 hours sufficiently to obtain a homogeneous mixture. The resulting pasty composition can be used directly as a treating material for applying the coupler (a) to a portion of the original sheet preselected to have a different hue by means of a brush or a pen. Alternately, it is charged into a ball pen or the like and applied to a portion of the original sheet preselected to have a different hue.

An oily substance that can disperse the above components uniformly therein and does not cause degradation or modification of these components can be used as the oily dispersion medium. For instance, linseed oil, paulownia oil, soybean oil, oleic acid, linolic acid, linoleic acid, other higher fatty acids, mineral oil and mixtures thereof are used, and linseed oil, paulownia oil and oleic acid are especially preferably used.

Coloring materials and binders such as mentioned with respect to the ink-like composition may also be used in the case of the pasty composition. As the organic solvent, those having a miscibility with the oily dispersion medium used are selected from solvents exemplified above as the liquid dispersion medium with respect to the ink-like composition, and they are used also in the case of the pasty composition. Those skilled in the art can readily select suitable organic solvent depending on the kind of the oily dispersion medium used or the like.

In order to promote the drying of the pasty composition after coating, it is possible to incorporate a small amount of a drying agent such as cobalt naphthenate in the pasty composition. Such drying agent is incorporated usually in an amount of up to 8 % by weight, preferably up to 5% by weight.

3. solid composition for treating the coupler-applied surface of an original (parenthesized range being a preferable range):

| | | |
|---|---|---|
| Coupler (a) | 2.0 – 95.0 % | (30.0 – 90.0 %) |
| Coloring material | 0 – 20.0 % | ( 0 – 5.0 %) |
| Extender | 0 – 50.0 % | ( 5.0 – 35.0 %) |
| Solid dispersion medium | balance | |

These components are blended together and heated to melt the solid dispersion medium, and the mixture is blended sufficiently under agitation to form a homogenous composition. Alternately, the solid dispersion medium is first heated and molten, and other components are blended into the melt and the mixture is sufficiently kneaded to obtain a homogeneous composition. The so obtained composition in the molten state is molded into a crayon, a chalk, a lip-stick or the like, and is used as the agent for treating the coupler-applied surface of the original sheet.

A substance that is solid at room temperature and melts at a temperature below the volatilization or sublimation point of the coupler (a), preferably at 50°–100°C., is used as the solid dispersion medium of the above solid composition. Examples of such substance include higher fatty acids having 10 or more carbon atoms, such as undecanoic acid, lauric acid, tridecanoic acid, myristic acid, pentadecanoic acid, palmitic acid, margaric acid, stearic acid, nonadecanoic acid, arachidic acid, behenic acid, cerotic acid and elaidic acid. These fatty acids may be used singly or in the form of mixtures of two or more of them. It is also possible to use these acids in the form of fatty acid glycerides or salts such as alkali metal salts, alkaline earth metal salts, ammonium salts and amine salts.

Especially preferably used fatty acids are palmitic acid, lauric acid, stearic acid and myristic acid.

Waxes are also used as the solid dispersion medium. Vegetable waxes such as carnauba wax and cotton wax, animal waxes such as bees wax and wool wax, montan wax, ozokerite, and petroleum waxes such as paraffin wax, micro wax and petrolatum. Among these waxes, paraffin wax and cotton wax are especially preferable. These waxes may be used in the form admixed with abovementioned fatty acids.

An extender can be added mainly for adjusting the hardness of the solid composition and improving its graphic properties. For instance, silica, talc, magnesia, clay, diatomaceous earth, activated clay, terra alba and inorganic powders such as zinc oxide and titanium oxide powders. Silica is most preferred from the viewpoint of a low ultraviolet absorption.

As the coloring material, those exemplified above with respect to the ink-like composition can be used.

4. composition for pressure-sensitive sheet for treating the coupler-applied surface of an original (parenthesized range being a preferable range):

| | | |
|---|---|---|
| Coupler (a) | 2.0 – 50.0 % | (10.0 – 35.0 %) |
| Coloring material | 0 – 20.0 % | ( 0 – 5.0 %) |
| Extender | 0 – 50.0 % | ( 5.0 – 35.0 %) |
| Oily dispersion medium | 10.0 – 50.0 % | (15.0 – 30.0 %) |
| Solid dispersion medium | balance | |

These components are preferably selected from those exemplified above with respect to the ink-like composition, the pasty composition and the solid composition.

These components are blended together and heated to melt the solid dispersion medium, and the mixture is sufficiently agitated to obtain a homogeneous composition. Alternately, the solid dispersion medium is first heated and melted, and other components are incorporated into the melt and the mixture is sufficiently kneaded to obtain a homogeneous composition. The so formed composition in the molten state is coated on a suitable base such as paper, fibrous cloth, plastic sheet or film according to a customary method. Thus, a pressure-sensitive sheet or ribbon can be prepared. The so formed pressure-sensitive sheet is superposed on an original sheet, and the assembly is pressed from the side of the original sheet by means of a typewriter bar or a writing tool, whereby a layer containing the coupler (a) can be applied to one surface of the original sheet. Further, when the pressure-sensitive sheet is used instead of an ordinary typewriter ribbon, a layer containing the coupler (a) can be applied to one surface of an original sheet by employing a typewriter.

In order to prevent occurrence of discoloration by the oxidation of the coupler (a), it is possible to add a reducing agent and/or an acidic substance to the above-mentioned ink-like composition, pasty composition, solid composition and pressure-sensitive sheet-preparing composition. As the reducing agent, substances having a relatively low reducing activity are employed. For instance, sodium thiosulfate, stannous chloride, sodium sulfite, hydrosulfide and thiourea dioxide are used as the reducing agent. It is preferable to employ acidic substances having a reducing activity in combination. For instance, organic acids such as citric acid, tartaric acid, oxalic acid and sulfamic acid, inorganic acids such as hydrochloric acid and phosphoric acid, and acidic inorgainc salts such as aluminum sulfate and acidic sodium sulfate are used as the acidic substance. Such reducing agents and acidic substances are usually incorporated in amounts not exceeding 10% by weight based on the total composition, preferably 2.5 to 7% by weight.

The above-mentioned compositions are coated on the coupler-applied surface of an original sheet and form a couplercontaining layer thereon. The coating or application of the composition can be accomplished by the pressure-sensitive transfer such as writing and typewriting.

The original sheet for the multi-color reproduction on which the coupler (a) has been applied with use of the abovementioned agent for treating the coupler-applied surface may be usually used 5 to 100 times repeatedly for the multi-color development, though the applicable frequency of the repeated use varies depending on the amount of coupler (a) coated, the coating method, the heating method and the developing method. Of course, when the heat-transferability of coupler (a) in the layer for heat-transferring the coupler is lowered, it is sufficient to supply newly an additional layer for heat-transferring the coupler.

The so formed original sheet for multi-color development is superposed on a diazo-type photosensitive material containing at least one diazonium compound (c) in a manner such that the layer of coupler (a) will confront the photosensitive surface of the photosensitive material, and the light-exposure and heating are effected coincidentally with the above superposition or after such superposition. Thus, the thermovolatile or thermosublimable coupler (a) is heat-transferred to the surface of the predetermined portion of the photosensitive material, and the light resolution of the diazonium salt (c) in the photosensitive material is caused to occur depending on the light transmission. When the so exposed photosensitive material is developed in the presence of the coupler (b) having a low coupling rate under developing conditions by a method known per se, at the predetermined portion to which the coupler (a) has been heat-transferred, the diazonium salt (c) at the non-exposed area is selectively reacted with the coupler (a) to form a dyestuff (c) – (a) and at other portion the diazonium salt (c) at the non-exposed portions is reacted with coupler (b) to form a dyestuff (c) – (b). thus, a multi-colored reproductive copy is obtained, in which the predetermined portion is colored in a hue different from that of the other portion.

As coupler (b) to be used in combination with the above-mentioned coupler (a) in conducting the process mentioned above, any coupler may be used as long as it has a lower coupling rate under the same developing conditions than coupler (a) actually used. In case a purality of thermovolatile or thermosublimable couplers (a) are used, the coupling rate of coupler (b) should be lower than that of any of couplers (a). Selection of couplers (a) and (b) meeting the above requirement may be easily performed by those skilled in the art based on a simple experiment.

In addition to those having relatively low coupling rates among the above exemplified couplers (a), the following compounds may be used as coupler (b):

Phenol Derivatives
2,5,6-Trimethylphenol
2-Hydroxymethylphenol
β-(2-Hydroxyphenyl)-propionic acid
2-(ω-Phenylaminomethyl)-phenol
β-(4-Methyl-2-hydroxyphenyl)-glutaric acid
2,5-Dimethyl-6-(N-dimethylaminomethyl)-phenol
1,3-Dimethyl ether of pyrogallol
N-Lauryl-p-aminophenol
N-acyl-m-aminophenol
Meta-hydroxy-acetoanilide
Ortho-N-hydroxyphenyl-monoguanidine
Para-N-hydroxyphenyl-biguanidine
2,5-Dimethyl-4-morpholinomethyl phenol
2-Methyl-5-isopropyl-morpholinomethyl phenol
4-Morpholinomethylresorcinol monomethyl ether
3,3′,5-Trihydroxydiphenyl
3,3′,5,5′-Tetrahydroxydiphenyl
2,2′,4,4′-Tetrahydroxydiphenyl
2,4,4′-Trihydroxydiphenyl-2′-sulfonic acid
2,4,6,3′,5′-Pentahydroxydiphenyl
2,2′,4,4′-Tetrahydroxydiphenyl sulfide Naphthols
2,3-Dihydroxynaphthalene-6-sulfonic acid
2-Naphthol-3,6-disulfonic acid
2,7-Dihydroxynaphthalene-3-sulfonic acid
2,8-Dihydroxynaphthalene-6-sulfonic acid
1,8-Dihydroxynaphthalene-8-sulfonic acid
1,8-Aminonaphthol-5-sulfonic acid
2,7-Dihydroxy-3,6-disulfonic acid
1,8-Benzoylaminonaphthol-2-sulfonic acid
1,8-Dihydroxynaphthalene-6-sulfonic acid
2-Hydroxy-3-naphthionic-N-β-hydroxyethyl amide
2-Hydroxy-3-naphthionic-N,N-bis-β-hydroxylether amide
8-Hydroxy-2-naphthionic-hydroxyethyl amide 1-(N-Carboethoxymethylamino)-8-naphthol-4-sulfonic acid
5-(Para-nitro)-benzamido-1-naphthol
1-Hydroxynaphthyl-7-phenyl-guanidine
2-Hydroxynaphthyl-8-biguanidine
1-Naphthol-3-(N-β-hydroxyethyl)-sulfonic amide
1-Naphthol-3-(N-o-methoxyphenyl)-sulfonic amide
Bis-[5-hydroxy-7-sulfo-naphthyl(2)]-amine
N,N-Bis[1-hydroxy-3-sulfo-naphthyl(6)]-thiourea Active Methylene Group-Containing Compounds Acetoacetic acid cyclohexylamide
Acetoacetic acid benzylamide
Cyanoacetoanilide
Cyanoacetomorpholine Heterocyclic Compounds 1-(3'-Sulfoamide)-phenyl-3-methylpyrazolone-5-
1-(4'-Carboxy-ethylphenyl)-3-dodecyl-pyrazolone-5
8-Hydroxy-1,2-naphthylimidazole
2-Methyl-4-hydroxybenzimidazole
7-Methyl-4-hydroxybenzothiazole
1,7-Dimethyl-4-hydroxy-benzotriazole
3-Hydroxythiophene-5-carboxylic acid
1,3,4-Cyclopentatrione Also, various photosensitive materials containing a diazonium salt (c) are used in this process according to the developing method. They are usually formed by coating a sensitizing composition a diazonium compound and, if necessary, a coupler (b) on a substrate such as paper, plastic film, fibrous fabric, non-woven fabric and metal foil. Such photosensitive material will be now described by referring to only a few examples.

A. Sensitizing composition for dry development:

| | |
|---|---|
| Azo coupling component (b) | 0.2 – 5.0 % |
| Diazo compound | 0.2 – 5.0 % |
| Organic acid | 0.1 – 5.0 % |
| Coloring matter | 0.001 – 0.025 % |
| Development promoter | 1.0 – 10.0 % |
| Extender | 0 – 2.5 % |
| Solvent | balance |

The sensitizing composition of the above recipe is coated on a substrate such as paper and plastic film, and dried to form a photosensitive sheet.

B. Two-component-type sensitizing composition for wet development:

| | |
|---|---|
| Azo coupling component (b) | 0.2 – 5.0 % |
| Diazo compound | 0.2 – 5.0 % |
| Organic acid | 0.1 – 5.0 % |
| Extender | 0 – 2.5 % |
| Stabilizer | 0 – 5.0 % |
| Coloring matter | 0.001 – 0.025 % |
| Solvent | balance |

The sensitizing composition of the above recipe is coated on a substrate such as paper and plastic film, and dried to form a photosensitive sheet.

C. One-component-type sensitizing composition for wet development:

| | |
|---|---|
| Diazo compound | 0.2 – 5.0 % |
| Organic acid | 0.1 – 5.0 % |
| Extender | 0 – 2.5 % |
| Coloring matter | 0.001 – 0.025 % |
| Solvent | balance |

The sensitizing composition of the above recipe is coated on a substrate such as paper, and dried to form a photosensitive paper.

Any diazonium compound that is capable of being coupled with the above-mentioned couplers (a) and (b) under ordinary developing condition may be used as the diazonium compound (c) in this invention. Examples of such diazonium compound are as follows:

Para-phenylene-diamine-N,N-substituted compound of the following general formula:

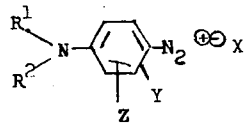

wherein X stands for an anion, $R^1$ and $R^2$ each are aliphatic hydrocarbon groups, and Z and Y denote substituents which can be introduced into the benzene nucleus.

Specific examples of the compounds of this type are as follows:

4-Diazo-N,N-dimethyl aniline
(referred to simply as "MA salt")
4-Diazo-N,N-diethyl aniline
(referred to simply as "EA salt")
4-Diazo-N-ethyl-N-β-hydroxyethyl aniline
(referred to simply as "EH salt")
4-Diazo-N,N-bis-β-hydroxyethyl aniline
4-Diazo-N-methyl-N-β-hydroxyethyl aniline
4-Diazo-N-ethyl-N-β-hydroxypropyl aniline
Other diazonium salts of p-phenylene diamines N,N-substituted with alkyl or hydroxy-alkyl groups
4-Diazo-N-ethyl-N-(β-diethylamino)-ethyl aniline
4-Diazo-2-chloro-N,N-diethyl aniline
4-Diazo-2-methyl-N,N-diethyl aniline
4-Diazo-2-iodo-N,N-diethyl aniline
4-Diazo-2-trifluoromethyl-N,N-diethyl aniline
4-Diazo-N-ethyl-N-benzyl aniline
4-Diazo-N-methyl-N-benzyl aniline (referred to simply as "methyl benzyl")

Aminohydroquinone ether-type compounds of the following general formula:

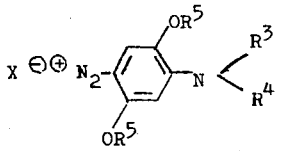

wherein $R^3$, $R_4$ and $R^5$ are alkyl or aryl groups and X stands for an anion.

Specific examples of the compounds of the above type are as follows:

4-Diazo-2,5-dibutoxy-N,N-diethyl aniline
4Diazo-2,5-diethoxy-N-benzoyl aniline (referred to simply as "BB salt")
4-Diazo-2,5-diethoxy-N-ethyl-N-benzoyl aniline
4-Diazo-2,5-dibenzyloxy-N-benzoyl aniline
4-Diazo-2-chloro-5-methoxy-N-benzoyl aniline
4-Diazo-2,5-diethoxy-N-benzoyl-methyl aniline
4-Diazo-2,5-diethoxy-N-benzoyloxy-methyl aniline
Other 4-diazo-2,5-dioxyalkyl (or dioxyaryl)-N-alkyl (or aryl) compounds and derivatives thereof Aminodiphenyl compounds, aminodiphenyl amine compounds and their analogues of the following general formulas:

$$X^{\ominus\oplus}N_2\text{-}R^6\text{-}A\text{-}R'$$ and $$X^{\ominus\oplus}N_2\text{-}R^6\text{-}A\text{-}R'\text{-}N_2^{\oplus\ominus}X$$

wherein X is an anion, R is a divalent aryl group, R′ is a monovalent or divalent aryl or alkyl group, A is a divalent group or a direct bond and examples of the R—A—R′ are diarylamine (A; —NH—), diphenyl (A; direct bond), diphenyl oxide (A; —O—), diaryl methane (A; —$CH_2$—), stilbene (A; —CH=CH—) and diaryl or dialkyl sulfide (A; —S—).

Specific examples of the compounds of the above type are as follows:

Para-diazophenyl amine
4-Diazo-2,5,4′-triethoxydiphenyl amine
4-Diazo-2,5,4′-triethoxydiphenyl
4,4′-Bis-diazo-2,2′,5,5′-tetrahydroxyphenyl methane
Bis-diazo-8,8′-dichloro-5,5′-dimethoxy benzidine
4-Diazo-2,5-dimethoxyphenylethyl sulfide
4-Diazo-2,5-diethoxy-4′-methyl diphenyl sulfide Heterocyclic amine derivatives of the following general formula:

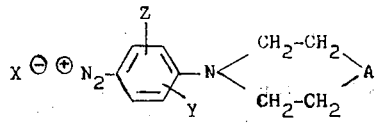

wherein X stands for an anion, Y and Z are substituents which can be introduced into the benzene nucleus, and A is a direct bond or a divalent group such as —O—, —S—to and methylene.

Specific examples of the compounds of this type are as follows:

4-Diazo-2,5-dibutoxy-N-phenyl morpholine
4-Diazo-2,5-diethoxy-N-phenyl morpholine
4-diazo-2-methoxy-N-chio morpholine
4-Diazo-N-phenyl piperidine
4-Diazo-N-phenyl pyrrolidone
4-Diazo-2,5-di-n-butoxy-N-phenyl piperidine Other derivatives of 4-Diazo-N-phenyl heterocyclic amines.

N,N-substituted ortho-phenylene diamine derivatives and orthoamino-phenol derivatives. Specific examples of the compounds of this type are as follows:

2-Diazo-4-methylmercapto-N,N′-dimethyl aniline
2-Diazo-5-benzoylamino-N,N′-dimethyl aniline
2-Diazo-1-naphthol-5-sulfonic acid The above-mentioned diazonium compounds may be used in the form of a relatively stable salt with sulfuric acid or hydrochloric acid. They may also be used in the form of a double salt with zinc chloride, tin chloride, aluminum sulfate or the like. Further, they may be used in the state stabilized by an aryl sulfonate (in the form of a diazonium salt of an aromatic sulfonic acid), a diazosulfonate or the like.

The exposure of the photosensitive material and the transfer of the thermovolatile or thermosublimable coupler (a) to the photosensitive surface may be effected coincidentally. For instance, in case a mercury lamp is used as light source for exposure, the heat transfer of the coupler (a) may be effected coincidentally with the exposure by the heat conveyed through a cylinder glass of the light soource maintained at a relatively high temperature. Of course, the heat transfer of the coupler (a) may be also effected by the radiation heating of an image of the original. The heat transfer of the coupler (a) may be effectively performed by heating the layer for heattransferring the coupler at a temperature above 50°C., preferably above 70°C. and up to 200°C., though a preferable heating temperature varies to some extent depending on the kind of the coupler (a) and the heating time. It is also possible to adopt a method comprising superposing the above-mentioned original for multi-color development and the photosensitive material, passing the assembly through a heated roller or an infrared radiation zone to heat the layer for heat-transferring the coupler at the above-mentioned temperature and to effect the heat transfer of the coupler, and then passing the same through an exposure zone to effect the exposure of the photosensitive material.

It is also possible to adopt a method in which the exposure and heat transfer are conducted in an order reverse to that of the above method, namely a method comprising superposing the original for multi-color development and the photosensitive material, passing the assembly through an exposure zone to effect the exposure of the photosensitive material and then passing the same through a heating zone to effect the heat transfer of the coupler (a).

In accordance with this invention, the photosensitive material which has been exposed to light and on a predetermined portion of which the coupler (a) has been heat-transferred, is developed in the presence of a coupler (b) by means known per se. It is possible to incorporate the coupler (b) in the photosensitive material in advance, or to incorporate the coupler (b) in a developer. The development may be conducted by either a dry method or a wet method.

In connection with the dry method, the development may be performed sufficiently only by exposing the lightexposed photosensitive material to a mixture of ammonia and steam. The development of a one-component-type photosensitive paper in use for the dry method may be carried out by coating a liquid developer having, for instance, the following recipe, on the photosensitive material by dipping, roller coating or spraying:

| | |
|---|---|
| Coupler (b) | 0.2 – 5 % |
| Alkali | 0.5 – 10 % |
| Reducing agent | 0 – 20 % |
| Surface active agent | 0 – 0.5 % |
| Water | balance |

In the case of a two-component-type photosensitive paper in use for the wet method, the development is achieved by contacting the photosensitive paper with an aqueous liquid developer containing an alkali.

Thus, in accordance with this invention multi-colored reproductive copies can be obtained in which the predetermined portion is colored by a dyestuff formed of coupler (a) and diazonium salt (c) and the other portion is colored by a dyestuff formed by coupler (b) and diazonium salt (c).

This invention will be detailed by referring to accompanying drawings.

Figure 2:
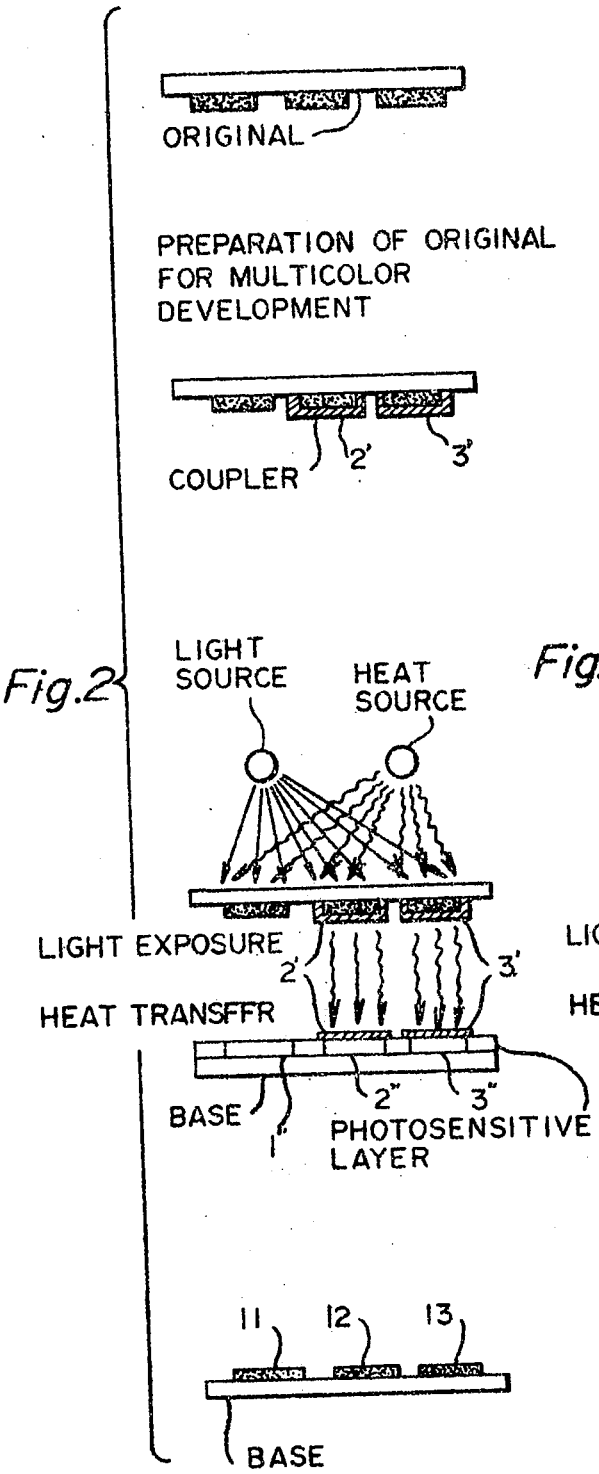
Figure 3:
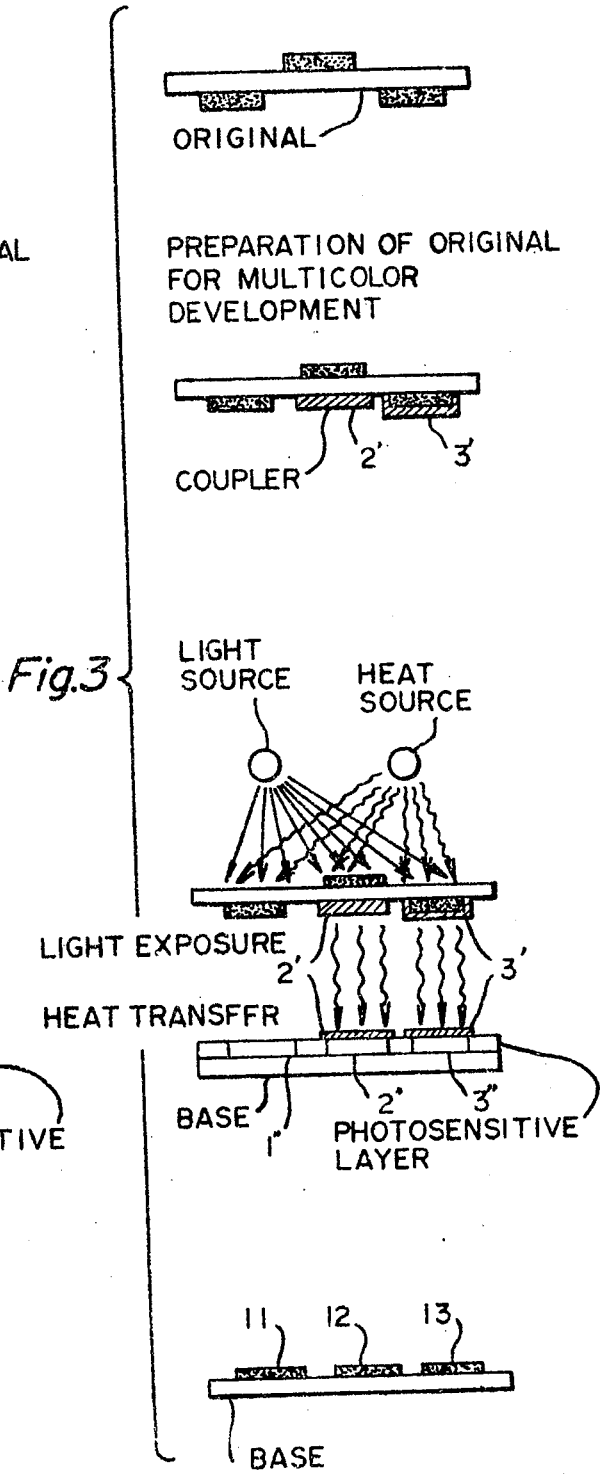
Figure 4:
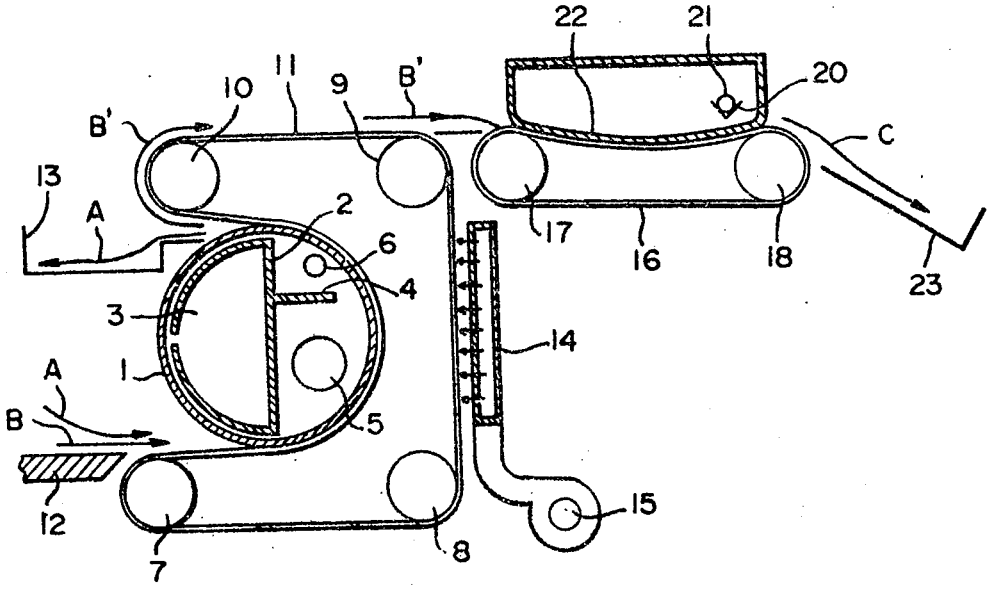
Figure 5:
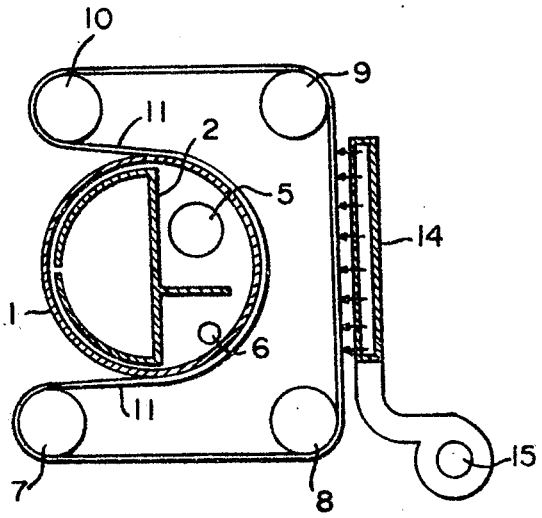
Figure 6:
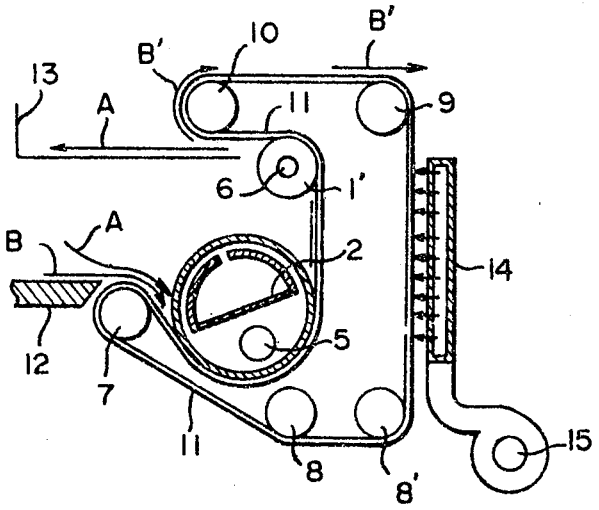
Figure 7:
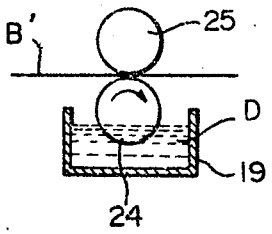
Figure 8:
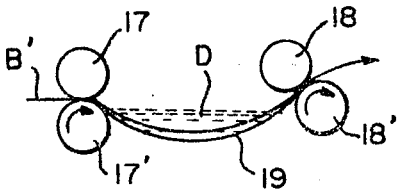
Figure 9:
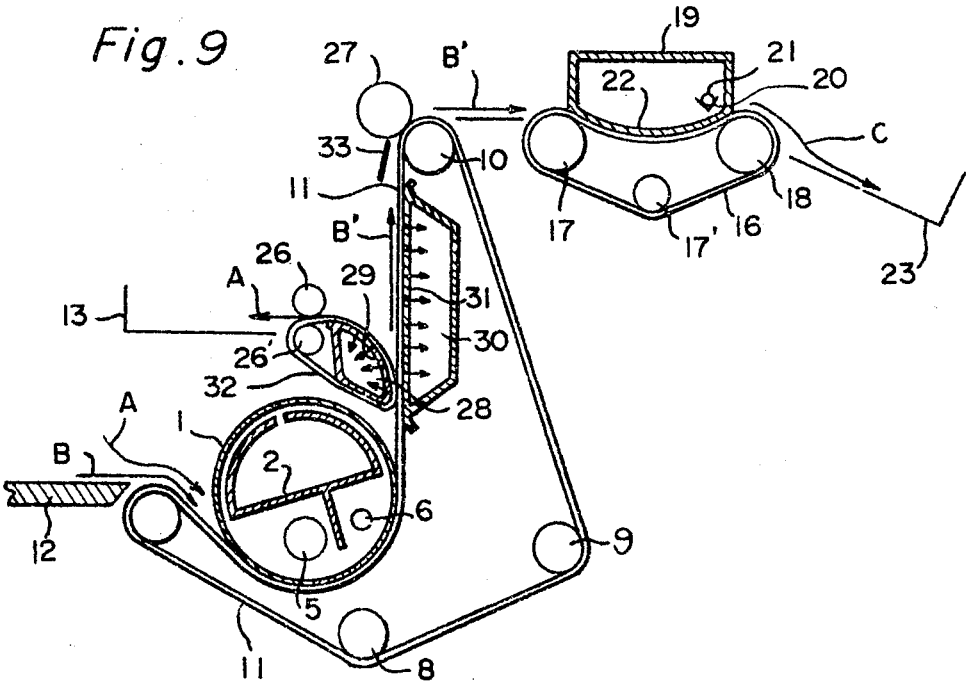
Figure 10:
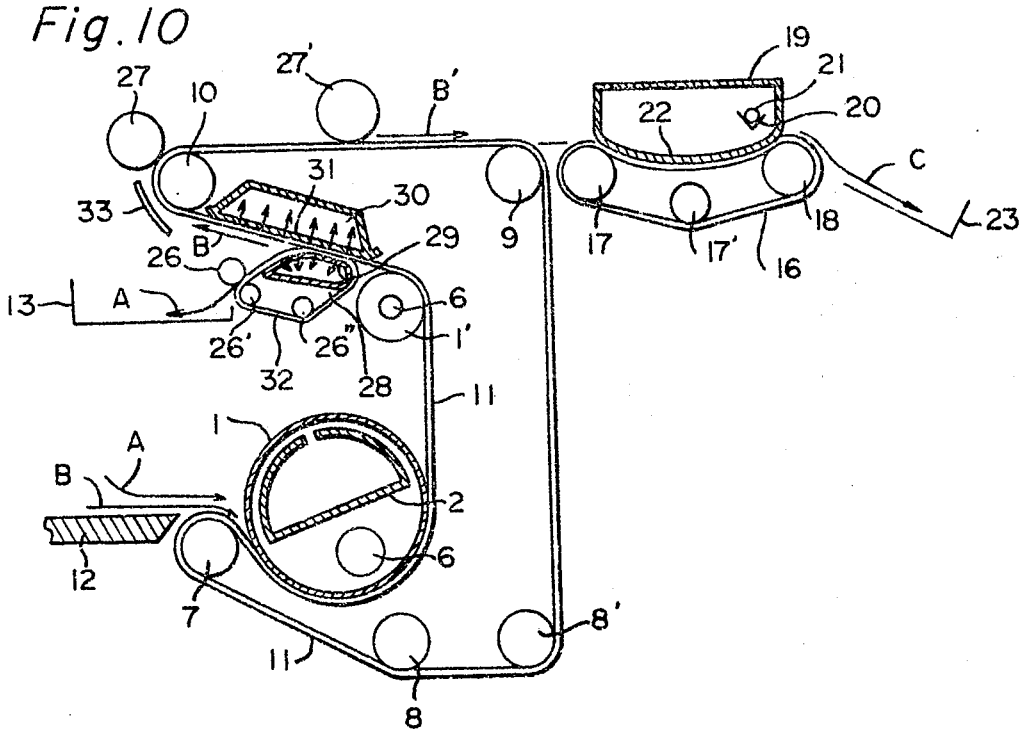
Figure 11:
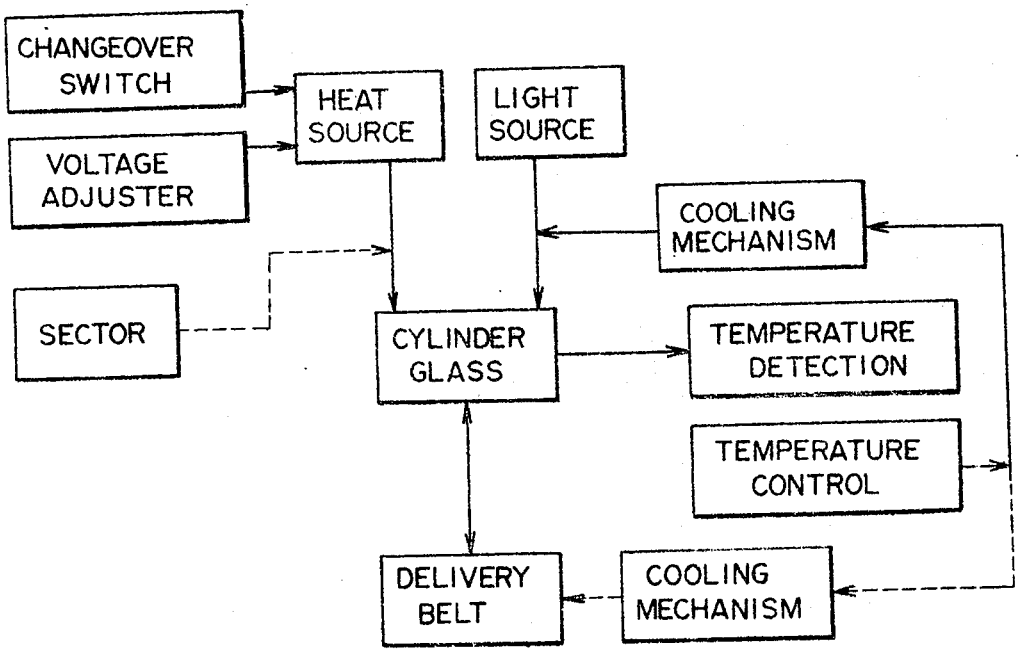

FIGS. 1 to 3 are given to explain the principles of light exposure, heat transfer and development. FIG. 4 is a sectional diagram showing one embodiment of the apparatus for practice of multi-color reproduction according to said principles. FIGS. 5 and 6 are views illustrating embodiments of the arrangement of a light source and a heat source. FIGS. 7 and 8 are views illustrating embodiments of the development mechanism. FIGS. 9 and 10 are views showing other embodiments of the apparatus for practice of multicolor reproduction according to said principles. FIG. 11 is a block diagram illustrating a control system to be adaptable to the apparatus of this invention.

The principle of the process is first described. In FIG. 1, different thermovolatile or thermosublimable coupler 2' and 3' are coated on the back surface of opaque images 2 and 3, respectively, of an original having images 1, 2 and 3. When the so formed original for multicolor development is superposed on a photosensitive paper, and exposed to light emitted from a suitable light source, latent images 1'', 2'' and 3'' corresponding to images 1, 2 and 3 are formed on the photosensitive layer of base and couplers 2' and 3' are transferred on the upper surface of the photosensitive layer. When the above photosensitive sheet is developed, the diazonium salt in latent images 2'' and 3'' of the photosensitive layer is selectively reacted with transferred couplers 2' and 3', while the diazonium salt in latent image 1'' is reacted with a coupler contained in the photosensitive layer. Thus, a reproductive copy which has images 11, 12 and 13 colored in different hues is obtained.

FIG. 2 is a view illustrating an embodiment similar to the above embodiment shown in FIG. 1, except that different thermovolatile or thermosublimable coupler 2' and 3' are coated on the surface of opaque image 2 and 3, respectively, of an original having opaque image 1, 2 and 3.

FIG. 3 illustrates another embodiment of the multicolor reproduction process where an original having an opaque image area 2 on one surface and opaque image areas 1 and 3 on the opposite surface is used as the original. Different thermovolatile or thermosublimable couplers 2' and 3' are coated on said opposite surface of the original at the portion continguous with the image 2 and on the surface of the image 3, and then, the light exposure, heat transfer and development are conducted by procedures as described by reference to the embodiment of FIG. 1, whereby a multi-color copy which has images 11, 12 and 13 colored in different hues can be obtained.

The above multi-color reproduction process can be performed by the following apparatus, namely an apparatus for the diazo-type multi-color reproduction which comprises a light source for exposing a diazo-type photosensitive material to light; a heat source for transferring a thermovolatile or thermosublimable coupler from a layer of the coupler to a photosensitive layer of the photosensitive material on which the coupler layer is overlapped; a developing mechanism for developing the light-exposed photosensitive material on which the coupler has been heat-transferred; and a delivery mechanism for feeding the diazo-type photosensitive material, the thermovolatile or thermosublimable coupler layer and the original to a device for subjecting them to actions of the light source and heat source while maintaining them in the overlapped state and contacting them with such device, and feeding only the light-exposed and heat-transferred photosensitive material to the development mechanism.

Any light source that can emit a light of a wavelength sufficient to resolve the diazonium salt in the photosensitive material may be used as a light source of the apparatus of this invention. A fluorescent lamp, a low voltage or high voltage mercury lamp, a xenon lamp, an arc lamp or an incandescent lamp may be optionally used. It is preferable that such light sources are contained in a rotatable transparent cylinder, so that the diazo-type photosensitive material is exposed to light in a close contact with the original. In case a light source is provided in transparent cylinder, a suitable cooling mechanism may be provided to cool the light source and transparent cylinder to suitable temperature.

Any heat source that can heat-transfer a thermovolatile or thermosublimable coupler to a photosenstive layer from a layer of the coupler formed at the back surface of the original and overlapped on the photosensitive layer may be used as a heat source of the apparatus of this invention. An electric heater, a heating roller, an infrared lamp, a heated jet or a high frequency heater may be optionally used. In order to conduct the heat transfer of the thermovolatile or thermosublimable coupler to the photosensitive layer effectively, it is preferable to prevent the escape of the coupler transferred to the diazo-type photosensitive layer by maintaining the thermovolatile or thermosublimable coupler layer at a temperature higher than that of the photosensitive layer and thus forming a temperature gradient between the two layers. To achieve the above result it is especially preferable to use an infrared lamp. Radiations emitted from an infrared lamp selectively heat images of the original, whereby the thermovolatile or thermosublimable coupler can be effectively heat-transferred to the diazo-type photosensitive layer from portions of the coupler layer corresponding to images. The wavelength of an infrared lamp is not critical, but based on experiments it was confirmed that in order to obtain as many multi-colored reproductive copies as possible from one original treated with the thermovolatile or thermosublimable coupler it is most preferred to use an infrared lamp that can radiate substantially near infrared rays. Also these heat sources may be contained in a rotatable cylinder in which they are contacted with a piled assembly of the original, the coupler layer and the photosensitive layer.

A superposed assembly of the original, the coupler layer and the photosensitive layer may be subjected to actions of the light source and heat source coincidentally. Alternately, it may be exposed at first to light by means of the light source and then heated by means of the heat source to effect the heat transfer. It is also possible to effect first the heat transfer by means of the heat source, followed by the light exposure by the light source.

The light source and heat source may be contained in a unit transparent cylinder. In this a case, a cold air duct of a semi-cylindrical form is fixed to a frame of the apparatus and a partition plate is provided on the reflecting surface of the cold air duct. In two chambers defined by partition plate, heat and light sources are separately provided to approximately to the cylinder surface. It is also possible to provide heat and light sources in two separate rotatable transparent cylinders or to provide only the light source in a transparent cylinder and to effect the heat transfer at a different place by means of a heating roller or a heated jet.

The diazo-type photosensitive material which has been exposed to light and on which the coupler has been heat-transfered is separated from the original and coupler layer, and it is fed alone to the development mechanism where it is developed. The development mechanism may be of either dry or wet type. In the case of the dry development, it is possible to use a developer mechanism of such a structure that a heated mixture of ammonia and steam is uniformly contacted with the photosensitive material. In the case of the wet development, a development mechanism in which a liquid developer for the wet development is coated on the photosensitive material by means such as roller coating, dipping coating and spraying is generally used.

The delivery mechanism comprises a device for subjecting the photosensitive material, the coupler layer and the original to actions of the light source and heat source, for instance, an endless belt driven in contact with a rotatable transparent cylinder, and a moving endless belt or at least one pair of rollers provided in contact with, or in proximity of, the development mechanism. The original, the thermovolatile or thermosublimable coupler layer and the diazo-type photosensitive layer overlapped in this order are allowed to pass through a passage formed between the endless belt and the light-exposure and heat-transfer zone where they are subjected to actions of the heat and light sources, whereby the photosensitive layer is exposed and the coupler is heat-transferred on the photosensitive layer, after which the photosensitive layer is forwarded from the light-exposure and heat-transfer zone, separated from the original and coupler layer manually or by suitable means, and then delivered to the development mechanism by means of an endless belt or rollers.

In this invention it is preferable to reduce the heat given to the endless belt to a minimum degree possible. Therefore, it is desired to provide a suitable cooling member or to select such material or color of the endless belt as being not easily heat-receivable.

In the embodiment illustrated in FIG. 4, in a rotatable, transparent cylinder 100, a cold air duct 300 one of whose walls constitutes a reflective plate 200 is provided. On the opposite side of the reflective plate 200, of the cold air duct two chambers are provided and they are defined by a reflective partition 4. In these chambers a light source 5 consisting of a high voltage mercury lamp and a heat source 6 consisting of an infrared lamp radiating substantially near infrared rays are mounted, respectively. Each of the light source 5 and heat source 6 is fixed to the reflective plate via a suitable supporting member. On the circumferential wall of the cold air duct 30 a hole-like or slit-like slots or the like is formed through which the cold air fed from one or both ends of the duct is projected to the inside of the cylinder. Thus, the cold air cools the light source 5 and the cylinder wall, and then is discharged from the side opposite to the duct. An endless belt 110 is mounted in the ⊐-figured form through rollers 7, 8, 9 and 10. The endless belt 110 is driven by means of, for instance, roller 7 and/or roller 10. By the movement of the endless belt 110, the cylinder 100 rotatably supported on the apparatus frame is also rotated. On the feed side of the endless belt 110 a paper-feeding table 120 may be provided, and an original receiving saucer 150 may be provided on the discharge side of the endless belt 110.

It is desired to prevent the endless belt, 110 as much as possible from being heated. For this purpose, it is possible to select the material or color of the endless belt as one not easily heat-receivable and/or to cool the endless belt 110 by providing between rollers 8 and 9 a cooling duct 14 with one or more openings the cold air fed from fan 15. Of course, it is also possible to maintain the temperature of the endless belt at low levels by cooling the roller 8 withh a suitable cooling medium instead of providing such cooling duct.

Another endless belt 16 is provided between rollers 17 and 18 in the position adjacent to the endless belt 110 and contacting a developer 19. The endless belt 16 is driven by means of a roller 18 at the rate synchronized with the endless belt 110. In the development 19 a plate 20 for evaporating aqueous ammonia and an evaporation heater 21 are provided. The gasified ammonia and steam are introduced onto the photosensitive layer through a plurality of openings formed in a wall 22 of the developer adjacent to the endless belt 16. It is possible to provide a saucer 23 for receiving reproductive copies on the discharge side of the endless belt 16.

When the reproduction is conducted by using the above-mentioned apparatus of this invention, as is shown in FIGS. 1 to 3, an original (A) on which is formed a layer of a thermovolatile or thermosublimable coupler is superposed on a diazo-type photosensitive material (B), and an assembly of (A) and (B) is fed to a passage between the cylinder 110 and the endless belt 110, exposed to light by means of the light source 5 and heated by means of the heat source 6. The original (A) and the photosensitive material (B′) on which the coupler has been transferred are discharged from between the cylinder 100 and the endless belt 110 and the original (A) is received on the saucer 130, while the photosensitive material (B′) is manually separated from the original (A), placed on the endless belt 110, and introduced into a passage formed between the endless belt 16 and the wall 22 of the developer where it is allowed to have a contact with gasified ammonia and steam and thus be developed. The developed copy (C) is received on the saucer 23.

It is also possible to effect the heat transfer of the coupler at first, and then the light exposure by providing, as is shown in FIG 5, a heat source 6 consisting of an infrared lamp in the lower portion of the cylinder 100 and a light source 5 consisting of a high voltage mercury lamp in the upper portion of the cylinder 100.

FIG. 6 illustrates an embodiment in which light source 5 and heat source 6 are provided separately. In the cylinder 100, a light source 5 consisting of an ultraviolet lamp is mounted on a reflective plate 2, and in another cylinder 101 a heat source 6 consisting of an infrared lamp is provided.

The endless belt 110 is driven by means of, for instance, rollers 7 and 10 and is rotated while being in contact with the cylinder 100 to rotate the same. Then, the endless blet 110 falls in contact with the cylinder 101 to rotate the same, and passes through rollers 10 and 9, a cooling zone, and rollers 8 and 8′ in this sequence. Instead of the infrared lamp 6 and cylinder 101 a hot wheel 101 provided with an electric heater 6 may be used as the heat source. The function and operation of each member are the same as in the embodiment shown in FIG. 1.

FIG. 7 illustrates an embodiment of the wet development mechanism using a liquid developer. A photosensitive material (B′) which has been exposed to light and on which the coupler has been transferred is dipped in a liquid developer (D) contained in a liquid developer tank 19′, and is allowed to pass through rotating roller 24 and developing roller 25 by which the liquid developer is coated on the photosensitive material (B′) and the development thereof is effected. The developing roller is formed of a material capable of maintaining thereon the liquid developer conveyed by the roller 24 and applying it to the photosensitive surface of the photosensitive material (B'), such as a multicellular material. In an embodiment shown in FIG. 8, the photosensitive material (B') which has been exposed to light and on which the coupler has been heat-transferred is dipped in the liquid developer contained in a developing saucer '' by means of a pair of paper-feeding rollers 17 and 17', and is developed. Then, the developed photosensitive material (B') is allowed to pass through a pair of squeezing rollers 18 and 18' and discharged in the form of a copy. In embodiment shown in FIGS. 7 and 8, roller 24, developing roller 25, paper-feeding rollers 17 and 17', and squeezing rollers 18 and 18' should be driven at a superficial speed synchronized with the endless belt running through the light-exposure and heat-transfer zones.

In an embodiment of the apparatus of this invention shown in FIG. 9, a roller 10 for supporting and rotating the endless belt 110 is provided in the direction almost vertical to the cylinder 100. Between the cylinder 100 and the roller 10 a suction chamber 30 is disposed contacting the back surface of the endless belt 110. A plurality of openings are formed on the wall 31 of the suction chamber 30 contacting the belt 110. On the opposite side of the endless belt 11 another suction chamber 28 is disposed to confront the suction chamber 30. In this suction chamber 28 a curved wall 29 having a plurality of openings is formed. At the other end of the suction chamber 28, rollers 26 and 26' are provided. An endless belt 32 is hung on the roller 26' and the suction chamber 28, and the belt 32 is driven by the driving roller 26' at a rate synchronized with the endless belt 110. The original (A) and the photosensitive material which has been exposed to light and on which the coupler has been heat-transferred is introduced into a passage formed between the driving belt 110 and the belt 32, and the original (A) is sucked to the belt 32 through perforations or openings of the belt 32 and received on a saucer 130 via rollers 26 and 26', while the photosensitive material (B') is sucked toward the suction chamber 30 through perforations or openings of the belt 110, allowed to move upwardly in the state adhering to the belt 110, and to pass through a passage between a guiding plate 33 and the belt 11, and delivered to the development mechanism while being gripped by a roller 27.

In the apparatus of the above type, the separation of the original from the photosensitive material which has been exposed to light and on which the coupler has been heat-transferred can be achieved automatically, and the photosensitive material can be automatically fed to the developing mechanism. Further, the belt 110 is cooled by the suction mechanism provided adjacent thereto. Accordingly, the apparatus of this type is very advantageous.

FIG. 10 illustrates an embodiment similar to that shown in FIG. 9, except that light source 5 and heat source 6 are provided in cylinders 100 and 101, respectively.

Also in the apparatus shown in FIGS. 9 and 10, it is possible to adopt other development mechanisms described with respect to the apparatuses shown in FIGS. 7 and 8.

In the apparatus employed in the practice of this invention it is preferable to provide a mechanism of controlling the temperatures of a cylinder glass and a delivery belt. A suitable temperature control mechanism adoptable in this invention is illustrated in the block diagram of FIG. 11. A temperature-detecting member such as a thermocouple or a thermistor is provided adjacent to the glass cylinder containing light and heat source or in contact therewith. A cold air duct such as described hereinabove is provided in the cylinder glass and the cooling of the cylinder glass may be effected and adjusted by the changeover of a motor switch of a cold air-feeding fan or by means of a throttle valve mounted on a duct of the fan. It is also possible to provide the delivery belt with a cooling mechanism such as described above. Since the delivery belt falls in contact with the cylinder glass, the temperature of the delivery belt is the same as, or a little lower than, the temperature of the cylinder glass. A certain range of the temperature is prescribed with respect to the cylinder glass depending on the kind or original and thermovolatile or thermosublimable coupler (for instance, optionally selected from temperature ranging from 60° to 150°C.), and when the temperature of the cylinder deviates from such prescribed range, the cooling mechanism for the cylinder glass, optionally together with the cooling mechanism of the delivery belt, is adjusted so as to control a further increase of the temperature. Thus, the temperature of the cylinder and delivery belt can be maintained at a certain prescribed level. Further, since the heat-transferable coupler layer which is positioned between the cylinder glass and delivery belt is more greatly heated by means of a heat source such as an infrared lamp, among the coupler layer, the photosensitive layer and the delivery belt, a temperature gradient suitable for the effective heat transfer of the coupler can be obtained. In order to keep the temperature of the coupler layer at an optimum condition for the heat transfer, it is possible to provide a device for adjusting the electric voltage of the heat source or a sector for adjusting amounts of infrared rays to be radiated. In order to make the apparatus of this invention applicable also to an ordinary diazo-type monochromatic reproduction process, it is desired to provide separately a changeover switch for the heat source.

In accordance with this invention it is possible to obtain copies in which predetermined portions are clearly colored in different hues, and further, the multicolor development can be effected only by one developing step. Still further, in case the original is once treated, at least 5 sheets, generally 20 to 100 sheets, of multi-colored reproductive copies can be obtained from the original. Accordingly, it is unnecessary to repeat the treatment of the original for every one copy. Still in addition, in this invention the treated original for multi-color development can be easily restored into the former untreated condition by peeling off the sheet of the heat-transferable coupler or by subjecting the coupler-coated original to a mere heat treatment at about 100°C.

The agent of this invention is particularly advantageous for reproducing important or significant portions of originals such as papers, drawings and charts into hues different from those of other portions and is effective for obtaining ordinary multi-color copies or colored copies.

This invention will be described hereinbelow by referring to examples.

EXAMPLE 1

Preparation of Ink-like Composition for Forming Red Color

The solution of the following recipe:

| | |
|---|---|
| 1-Phenyl-3-methyl-pyrazolone (5) | 25 g |
| Alkyd resin | 5 g |
| Thiourea | 5 g |
| Ethyleneglycol | 10 g |
| Ethanol | balance |
| Total | 100 ml |

is prepared by dissolving the above ingredients successively into a part of ethanol under agitation, and after they have completely been dissolved, the remainder of ethanol is added to the solution to make the total volume of the solution 100 ml. The so obtained red-color-forming ink-like composition is charged into a vessel, and it is used as a treating agent to be applied to a portion of an original preselected to be colored in red. The application of the composition may be conducted by means of a brush, a pen, a coating roller. Alternately, the composition can be impregnated into an installed felt pen and applied to the original.

EXAMPLES 2 TO 11

Coupler-containing agents for treating original or installed felt pens are prepared by repeating procedures of Example 1 using the following ink-like compositions instead of the red-color-forming ink-like composition of Example 1.

EXAMPLE 2

A yellow-color-forming ink-like composition of the following recipe:

| | |
|---|---|
| Acetoacetic acid anilide | 25 g |
| Polyvinyl acetal resin | 5 g |
| Glycerine | 10 g |
| Sodium thiosulfate | 3 g |
| Methanol | balance |
| Total | 100 ml |

Example 3

A blue-color-forming ink-like composition of the following recipe:

| | |
|---|---|
| 2,3-Dihydroxynaphthalene | 25 g |
| Cellulose diacetate resin (20 % acetone solution) | 15 g |
| Thiourea | 3 g |
| Ethanol | balance |
| Total | 100 ml |

Example 4

A yellowish brown-color-forming ink-like composition of the following recipe:

| | |
|---|---|
| Resorcinol | 25 g |
| Vinyl acetate resin emulsion | 10 ml |
| Thiourea | 5 g |
| Citric acid | 3 g |
| Water | 30 ml |
| Ethanol | balance |
| Total | 100 ml |

Example 5

A brown-color-forming ink-like composition of the following recipe:

| | |
|---|---|
| Pyrogallol | 20 g |

-continued

| | |
|---|---|
| Ethyl cellulose | 5 g |
| Tartaric acid | 5 g |
| Stannous chloride | 5 g |
| Ethanol | balance |
| Total | 1 liter |

Example 6

A violet-color-forming ink-like composition of the following recipe:

| | |
|---|---|
| 2,3-Dihydroxynaphthalene | 20 g |
| 1-Phenyl-3-methylpyrazolone-(5) | 5 g |
| Butylated urea resin | 5 g |
| Diethylene glycol | 10 g |
| Methanol | balance |
| Total | 100 ml |

Example 7

A bluish violet-color-forming ink-like composition of the following recipe:

| | |
|---|---|
| 5-Hydroxy-3-hydroxymethyl-γ-pyrone | 20 g |
| Vinylidene chloride resin | 5 g |
| Ethyleneglycol | 10 g |
| Ethyl acetate | 15 ml |
| Butanol | balance |
| Total | 1 liter |

Example 8

A dark brown-color-forming ink-like composition of the following recipe:

| | |
|---|---|
| Bromoresorcinol | 25 g |
| Polyamide resin | 5 g |
| Thiourea | 5 g |
| Ethyl acetate | 15 ml |
| Propanol | balance |
| Total | 100 ml |

Example 9

A brown-color-forming ink-like composition of the following recipe:

| | |
|---|---|
| m-Aminophenol | 25 g |
| Styrene-maleic acid copolymer resin | 5 g |
| Glycerine | 10 g |
| Sodium sulfide | 3 g |
| Methanol | balance |
| Total | 100 ml |

Example 10

A bluish-violet-color-forming ink-like composition of the following recipe:

| | |
|---|---|
| 1,7-Dihydroxynaphthalene | 20 g |
| Acetyl cellulose | 5 g |
| Ethyleneglycol | 10 g |
| Thiourea | 5 g |
| Acetone | 25 ml |
| Methanol | balance |
| Total | 100 ml |

Example 11

An orange-color-forming composition of the following recipe:

| | |
|---|---|
| 1-(3'-Chlorophenyl)-3-methyl-pyrazolone-(5) | 25 g |
| Styrene-acrylic acid copolymer resin | 5 g |
| Tartaric acid | 5 g |
| Diethyleneglycol | 10 g |
| Acetone | 30 g |
| Ethanol | balance |
| Total | 100 ml |

EXAMPLE 12

Preparation of Red-Color-Forming Pasty Composition

The following ingredients

| | |
|---|---|
| 1-Phenyl-3-methylpyrazolone-(5) | 40 g |
| Linseed oil-modified alkyd resin | 8 g |
| Linolic acid | 10 g |
| Cobalt naphthenate | 5 g |
| Linseed oil | balance |
| Total | 100 ml |

are pre-mixed under agitation, and they are uniformly blended and dissolved by treating them in a ball mill for 2 – 3 hours to obtain a red-color-forming pasty composition. The composition is directly used as a red-color-forming agent to be applied to a portion of an original preselected to be colored in red by means of a brush or a pen, or after it has been charged into a ball pen or the like, it is used as a material for treating a portion of an original preselected to be colored in red.

EXAMPLES 13 TO 20

Pasty agents to be used for treating a portion of an original preselected to be colored in different hues and ball pens charged with such agents are prepared in the same manner as in Example 12 by employing the following compositions instead of the composition of Example 12.

Example 13

A yellow-color-forming pasty composition of the following recipe

| | |
|---|---|
| Acetoacetic acid anilide | 30 g |
| Oleic acid | 10 g |
| Stearic acid | 20 g |
| Paulownia oil | balance |
| Total | 100 ml |

Example 14

A blue-color-forming pasty composition of the following recipe

| | |
|---|---|
| 2,3-Dihydroxynaphthalene | 30 g |
| Polyvinyl acetal resin | 10 g |
| Thiourea | 5 g |
| Ethanol | 10 ml |
| Oleic acid | 10 g |
| Oil Blue (C.I. 74350) | 1 g |
| Mineral oil | balance |
| Total | 100 ml |

Example 15

A yellowish brown-color-forming pasty composition of the following recipe

| | |
|---|---|
| Resorcinol | 35 g |
| Ethyl cellulose | 7 g |
| Thiourea | 5 g |

-continued

| | |
|---|---|
| Methanol | 7 ml |
| Oleic acid | 5 g |
| Palmitic acid | 5 g |
| Linseed oil | balance |
| Total | 100 ml |

Example 16

A violet-color-forming pasty composition of the following recipe:

| | |
|---|---|
| 1-Phenyl-3-methylpyrazolone-(5) | 35 g |
| 2,3-Dihydroxynaphthalene | 9 g |
| Soybean oil-modified alkyd resin | 10 g |
| Oleic acid | 15 g |
| Stannous chloride | 5 g |
| Soybean oil | balance |
| Total | 1 liter |

Example 17

A reddish orange-color-forming pasty composition of the following recipe:

| | |
|---|---|
| 1-Phenyl-3-carboxypyrazolone | 35 g |
| Ethyl cellulose | 5 g |
| Methanol | 5 ml |
| Oleic acid | 15 g |
| Linseed oil | balance |
| Total | 100 ml |

Example 18

A yellowish brown-color-forming pasty composition of the following recipe:

| | |
|---|---|
| Resorcinol monoglycol ether | 30 g |
| Paulownia oil | 35 g |
| Cobalt naphthenate | 10 g |
| Thiourea | 5 g |
| Oleic acid | balance |
| Total | 100 ml |

Example 19

A bluish violet-color-forming pasty composition of the following recipe:

| | |
|---|---|
| 2,7-Dihydroxynaphthalene | 30 g |
| Butylated urea resin | 8 g |
| Methanol | 10 ml |
| Soybean oil | 10 g |
| Oleic acid | balance |
| Total | 100 ml |

Example 20

A brown-color-forming pasty composition of the following recipe:

| | |
|---|---|
| 4-Chlororesorcinol | 35 g |
| Styrene-maleic acid copolymer resin | 10 g |
| Oleic acid | 10 g |
| Methanol | 5 ml |
| Sodium sulfite | 5 g |
| Linseed oil | balance |
| Total | 100 ml |

EXAMPLE 21

Preparation of Red-Color-Forming Solid Composition:

A red-color-forming agent for treating a portion of an original preselected to be colored in red is prepared from a red-color-forming composition of the following recipe:

| | |
|---|---|
| 1-Phenyl-3-methyl-pyrazolone-(5) | 50 g |
| Palmitic acid | 30 g |
| Talc ("Hifiller" manufactured by Matsumura Sangyo Kabushiki Kaisha) | 15 g |
| $SiO_2$ ("Aerogil" manufactured by Nippon Aerogil Kabushiki Kaisha) | 5 g |

in the following manner. Namely, palmitic acid is charged into a mixer, and heated and molten at 90°C. The coupler, talc and $SiO_2$ are added to the melt and the mixture is agitated for 20 – 30 minutes. The so formed semi-molten mixture is sufficiently kneaded by means of three rolls. The kneaded composition is placed into a molder and is molded in a crayon, chalk or lip-stick form. It is used as an agent for treating a portion of an original preselected to be colored in a different hue. Alternately, the above kneaded composition is pre-molded into a column of a diameter of about 25 mm and a length of about 15 cm and then molded into a pencil lead by means of an extension molder. Then, a wooden or paper reinforcing material is bonded on wrapped around the so molded lead to obtain a pencil-like agent for treating a portion of an original preselected to be colored in a different hue.

EXAMPLES 22 – 29

Crayon-like, chalk-like, lip-stick-like or pencil-like solid compositions to be used as agents for treating a portion of an original preselected to be colored in a different hue are prepared in the same manner as in Example 21 by employing the following solid compositions instead of the composition of Example 21.

Example 22

A yellow-color-forming solid composition of the following recipe:

| | |
|---|---|
| Acetoacetic acid anilide | 50 g |
| Stearic acid | 30 g |
| Paraffin | 10 g |
| Terra alba | 5 g |
| $SiO_2$ (Carplex No. 80 manufactured by Shionogi Seiyaku Kabushiki Kaisha) | 5 g |

Example 23

A blue-color-forming solid composition of the following recipe:

| | |
|---|---|
| 2,3-Dihydroxynaphthalene | 50 g |
| Lauric acid | 30 g |
| Talc ("Hifiller" manufactured by Matsumura Sangyo Kabushiki Kaisha) | 10 g |
| Bees wax | 10 g |

Example 24

A brown-color-forming solid composition of the following recipe:

| | |
|---|---|
| Pyrogallol | 50 g |
| Lauric acid | 35 g |
| Diatomaceous earth | 10 g |
| Thiourea | 5 g |

Example 25

A violet-color-forming solid composition of the following recipe:

| | |
|---|---|
| 2,3-Hydroxynaphthalene | 40 g |
| 1-Phenyl-3-methylpyrazolone-(5) | 10 g |
| Palmitic acid | 25 g |
| Paraffin | 10 g |
| ZnO | 10 g |
| Thiourea | 5 g |

Example 26

A black-color-forming solid composition of the following recipe:

| | |
|---|---|
| 2,3-Hydroxynaphthalene | 35 g |
| 1-Phenyl-3-methylpyrazolone-(5) | 7 g |
| Resorcin | 7 g |
| Stearic acid | 35 g |
| MgO | 6 g |
| Diatomaceous earth | 5 g |

Example 27

A reddish brown-color-forming solid composition of the following recipe:

| | |
|---|---|
| Dimethyl-m-aminophenol | 50 g |
| Lauric acid | 30 g |
| Titanium oxide | 10 g |
| Stannous chloride | 5 g |
| Paraffin | 5 g |

Example 28

A reddish-orange-color-forming solid composition of the following recipe:

| | |
|---|---|
| 1-(p-Toluyl)-3-methylpyrazolone-(5) | 50 g |
| Palmitic acid | 30 g |
| Activated clay | 10 g |
| Cotton wax | 10 g |

Example 29

A brown-color-forming solid composition of the following recipe:

| | |
|---|---|
| o-Aminophenol | 50 g |
| Paraffin | 15 g |
| Stearic acid | 15 g |
| $SiO_2$ (Carplex No. 80 manufactured by Shionogi Seiyaku Kabushiki Kaisha) | 15 g |
| Stannous chloride | 5 g |

EXAMPLE 30

Preparation of Pressure Sensitive Sheet

A red-color-forming composition for a pressure sensitive sheet having the following recipe

| | |
|---|---|
| 1-Phenyl-3-methylpyrazolone-(5) | 25 g |
| Talc ("Hifiller" manufactured | |

-continued

| | |
|---|---|
| by Matsumura Sangyo Kabushiki Kaisha) | 7 g |
| $SiO_2$ (Aerogil 200 manufactured by Nippon Aerogil Kabushiki Kaisha) | 3 g |
| Mineral oil | 25 g |
| Palmitic acid | 15 g |
| Oleic acid | 15 g |
| Permanent Red | 10 g |

in the following manner. Namely, the above ingredients are successively thrown into a mixer, and they are preheaded at 90°C. for 20 – 30 minutes. The resulting mixture is placed in a ball mill and mix-granulated at 80°–90°C. for 2 – 3 hours. Then, the composition in the state heated at 80°–90°C. is coated on a base paper for a pressure-sensitive copying sheet in an amount of about 25 g/m² by a rod bar coating method, and dried to obtain a pressure-sensitive sheet. This pressure-sensitive sheet is superposed on an original sheet in the same manner as adopted for ordinary pressure-sensitive paper, at a portion of the original sheet preselected to be colored in red.

EXAMPLES 31 TO 36

Pressure-sensitive sheets as agents for treating a portion of an original preselected to be colored in a different hue are prepared in the same manner as in Example 30 by employing the following compositions instead of the composition of Example 30.

Example 31

A yellow-color-forming composition for a pressure-sensitive sheet having the following recipe:

| | |
|---|---|
| Acetoacetic acid anilide | 25 g |
| Stearic acid | 15 g |
| Paraffin | 5 g |
| Linseed oil | 15 g |
| Mineral oil | 30 g |
| Diatomaceous earth | 10 g |

Example 32

A blue-color-forming composition for a pressure-sensitive sheet having the following recipe:

| | |
|---|---|
| 2,3-Hydroxynaphthalene | 25 g |
| Lauric acid | 15 g |
| Talc ("Hifiller" manufactured by Matsumura Sangyo Kabushiki Kaisha) | 5 g |
| Cotton wax | 30 g |
| Paulownia oil | 30 g |
| Oleic acid | 15 g |
| Oil Blue (C.I. 74350) | 5 g |

Example 33

A brown-color-forming composition for a pressure sensitive sheet having the following recipe:

| | |
|---|---|
| Pyrogallol | 25 g |
| Lauric acid | 15 g |
| Diatomaceous earth | 10 g |
| Paraffin | 5 g |
| Soybean oil | 30 g |
| Mineral oil | 10 g |
| Thiourea | 5 g |

Example 34

A black-color-forming composition for a pressure sensitive sheet having the following recipe:

| | |
|---|---|
| 2,3-Dihydroxynaphthalene | 18 g |
| 1-Phenyl-3-methylpyrazolone-(5) | 4 g |
| Resorcin | 3 g |
| Stearic acid | 20 g |
| Titanium oxide | 10 g |
| Linseed oil | 10 g |
| Mineral oil | 25 g |
| Cobalt naphthenate | 5 g |
| Carbon black | 5 g |

Example 35

A bluish violet-color-forming composition for a pressure-sensitive sheet having the following composition:

| | |
|---|---|
| 1,6-Dihydroxynaphthalene | 25 g |
| Palmitic acid | 15 g |
| MgO | 10 g |
| Thiourea | 5 g |
| Oleic acid | 15 g |
| Mineral oil | 30 g |

Example 36

A violet-color-forming composition for a pressure-sensitive sheet having the following composition:

| | |
|---|---|
| 2,3-Dihydroxynaphthalene | 20 g |
| 1-Phenyl-3-methylpyrazolone-(5) | 5 g |
| Palmitic acid | 15 g |
| Paraffin | 5 g |
| ZnO | 10 g |
| Linseed oil | 30 g |
| Oleic acid | 10 g |
| Cobalt naphthenate | 5 g |

The process for obtaining diazo-type multi-colored copies with use of treating agents of this invention will now be illustrated by reference to Application Examples.

APPLICATION EXAMPLE 1

Multi-color-forming photosensitive paper for use in dry development

A solution of the following recipe is prepared:

| | |
|---|---|
| 4-Diazo-N,N-dimethylaniline chloride .½ $ZnCl_2$ | 15 g |
| Ethylene glycol | 50 g |
| Citric acid | 20 g |
| Sodium 2,3-dihydroxynaphthalene-3,6-disulfonate | 8 g |
| Zinc chloride | 20 g |
| Thiourea | 100 g |
| Sodium 1,3,6-naphthalenetrisulfonate | 20 g |
| Patent Blue | 0.1 g |
| Water | balance |
| Total | 1 liter |

The solution is coated on a base paper by a customary coating precedure such as using an air knife coater and dried to form a photosensitive sheet.

The sheet is superposed on an original in which the back surface of a portion is treated with the solid treating agent prepared in Example 21 and the back surface of another portion is treated with the treating agent prepared in Example 24. Then, the assembly is heated and exposed to light by means of a mercury lamp to form a latent image of the diazonium salt.

Next, the so treated sheet is subjected to development with gasified ammonia and steam. Thus, a clear multicolor copy of a high color contrast is obtained, in which a portion corresponding to the portion treated with the agent of Example 21 is colored in red, a portion corresponding to the portion treated with the agent of Example 24 is colored in brown and other portion corresponding to the untreated portion is colored in dark blue.

APPLICATION EXAMPLE 2

Multi-color-forming photosensitive paper for use in either wet or dry development A solution of the following recipe is prepared:

| | |
|---|---|
| 4-Diazo-2,5-dibutoxy-N-phenyl morpholine.½ $ZnCl_2$ | 15 g |
| Citric acid | 30 g |
| Diethylene glycol | 40 g |
| β-Hydroxynaphthoic acid aminoethyl amine (hydrochloride) | 7 g |
| Thiourea | 40 g |
| Zinc chloride | 30 g |
| Patent Blue | 0.1 g |
| Water | balance |
| Total | 1 liter |

In the same manner as in Example 1, a photosensitive paper is prepared from the above solution by coating and drying. The photosensitive paper is superposed on an original, a part of the back surface a pattern of which is treated with the treating agent of Example 30 and another part of the back surface of which is treated with the agent of Example 31. Then, the assembly is heat treated in a manner such that the treated surface of the original confronts to the photosensitive layer of the photosensitive paper, and exposed and printed by means of a fluorescent lamp to form a latent image of the diazonium salt, followed by development with gasified ammonia and steam or an alkaline liquid developer of the following recipe:

| | |
|---|---|
| Potassium carbonate | 20 g |
| Sodium thiosulfate | 40 g |
| Sodium bicarbonate | 30 g |
| Potassium tetraborate | 5 g |
| Water | balance |
| Total | 1 liter |

Thus, a clear three-color reproductive copy is obtained, in which a portion corresponding to the part of the original treated with the agent of Example 30 is colored in red, a portion corresponding to the part of the original treated with the agent of Example 31 is colored in yellow and a portion corresponding to the untreated part is colored in blue.

APPLICATION EXAMPLE 3

Multi-color-forming diazo-type photosensitive paper for use in wet development

10 G of a double salt of 4-diazo-2,5-diethoxybenzoylaniline chloride·½ $ZnCl_2$, 8 g of citric acid, 0.1 g of Patent Blue and 10 g of dextrin are successively dissolved in water, to make 1 liter of a solution. The solution is coated on a base paper and dried to obtain a diazo-type photosensitive sheet for wet development.

A semi-transparent first original having an image and a photosensitive sheet for a diazo-type intermediate copying original prepared by a customary method are superposed, and the assembly is exposed to light emitted from above to form an intermediate copying original. A part of the image of this intermediate copying original is treated with the ink composition prepared in Example 1 and another part of the image is treated with the treating material prepared in Example 2 to obtain an original for multi-color reproduction.

The so formed original for multi-color reproduction is superposed on the above photosensitive sheet so that the treated surface of the original has a close face-to-face contact with the photosensitive layer of the photosensitive material, and the assembly is heated by a mercury lamp to form a latent image of the diazonium salt and simultaneously heat-transfer 4 the heat-transferable couplers to the areas of the photosensitive sheet corresponding to the treated parts of the original. Then, the so exposed and heat-transferred photosensitive sheet is developed with use of a liquid developer of the following recipe:

| | |
|---|---|
| NW acid | 20 g |
| Potassium carbonate | 20 g |
| Sodium thiosulfate | 40 g |
| Sodium bicarbonate | 30 g |
| Activating agent | 1 g |
| Water | balance |
| Total | 1 liter |

Thus, a clear multi-color reproductive copy in which a portion corresponding to the portion treated with the treating material prepared in Example 1 is colored in a red, a portion corresponding to the portion treated with the treating material of Example 2 is colored in yellow and other portion corresponding to the non-treated portion is colored in bluish violet is obtained.

APPLICATION EXAMPLE 4

Multi-color-forming diazo-type photosensitive paper for use in dry development

A solution of the following recipe is prepared:

| | |
|---|---|
| 4-Diazo-N-ethyl=N-β-hydroxyethylaniline chloride.½ $ZnCl_2$ | 10 g |
| Ethylene glycol | 50 g |
| Citric acid | 20 g |
| Bis-[5-hydroxy-7-sulfonaphthyl(2)] amine | 15 g |
| Zinc chloride | 40 g |
| Thiourea | 30 g |
| Patent Blue | 0.1 g |
| Water | balance |
| Total | 1 liter |

The solution is coated on a base paper by a customary coating procedure such as using an air knife coater and dried to form a photosensitive sheet.

An intermediate copying original having opaque reverse images is prepared according to the customary diazo-type reproduction method. The surface of a preselected reverse image of the intermediate copying sheet is treated with the pasty treating agent prepared in Example 13, the surface of another preselected reverse image is treated with the treating agent prepared in Example 12, and the surface of still another preselected reverse image is treated with the treating agent prepared in Example 14. The so treated intermediate copying original is superposed on the above photosensitive sheet so that the treated surface of the original has a face-to-face contact with the photosensitive layer of the photosensitive sheet. Then the assembly is heated and exposed to light by means of a mercury lamp to form a latent image of the diazonium salt and effect the heat transfer of the coupler.

Next, the so treated sheet is subjected to development with gasified ammonia and steam. Thus, a clear multi-color copy in which a portion corresponding to the portion treated with the agent of Example 13 is colored in yellow, a portion corresponding to the portion treated with the agent of Example 12 is colored in red, a portion corresponding to the portion treated with the agent of Example 14 is colored in bluish violet, and other portion corresponding to the untreated portion is colored in dark blue is obtained.

APPLICATION EXAMPLE 5

Multi-color forming diazo-type photosensitive paper for use in dry development

A solution of the following recipe is prepared:

| | |
|---|---|
| 4-Diazo-N,N-dimethylaniline chloride.½ $ZnCl_2$ | 15 g |
| Glycerine | 50 g |
| Tartaric acid | 40 g |
| Sodium 2,3-dihydroxy-naphthalene-3,6-disulfonate | 15 g |
| Zinc chloride | 30 g |
| Thiourea | 50 g |
| Patent Blue | 0.1 g |
| Water | balance |
| Total | 1 liter |

The solution is coated on a base for a photosensitive paper by means of an air knife coater and dried to obtain a photosensitive paper for multi-color reproduction.

Separately, a semi-transparent original having an opaque image is superposed on a conventional diazo-type photosensitive sheet (for yellowish brown coloration) for an intermediate copying sheet so that the image surface of the original has a face-to-face contact with the photosensitive layer of the photosensitive material, and the assembly is exposed to ultraviolet rays emitted from the side of the original and developed with ammonia-steam to form an intermediate copying original. Then, in the so formed original a second image is written on the surface opposite to the image-carrying surface to thereby obtain an original having image on both surfaces. The surface of a part of one image on one surface of the original is treated with the solid agent prepared in Example 21 and the back surface of the second image on the opposite surface of the original is treated with the treating agent of Example 22 to obtain an original for multi-color reproduction.

The so formed original is superposed on the above photosensitive paper so that the treated surface of the original has a face-to-face contact with the photosensitive layer of the photosensitive paper. Then, the assembly is exposed to light and heat emitted from the side of the original to thereby form a latent image of the diazonium salt and simultaneously accomplish the heat transfer of the heat-transferable couplers. The so treated photosensitive layer is developed with ammoniasteam. Thus, a three-color copy is obtained, in which the portion corresponding to the part treated with the treating agent of Example 21 is colored in red, the portion corresponding to the part treated with the treating agent of Example 22 is colored in yellow and the portion corresponding to the untreated part is colored in blue.

We claim:

1. A solid treating agent in the form of a pencil, crayon, chalk or lipstick stick-like writing implement for treating the coupler-applied surface of an original in use for diazo-type multicolor reproduction which consists essentially of a homogeneous composition containing 30–90% by weight based on the total weight of the solid treating agent of a thermovolatile or thermosublimable coupler capable of being coupled with diazonium salt to form a dyestuff, 0–5.0% based on the total weight of the solid treating agent by weight of a coloring material, 5–35% by weight based on the total weight of the solid treating agent of an extender selected from the group consisting of silica, talc, magnesia, clay, diatomaceous earth, activated clay, terra alba, zinc oxide and titanium oxide, and a solid dispersion medium which is solid at room temperature and has a melting point below the volatilization of sublimation point of said coupler in an amount sufficient to provide said homogeneous mixture from the group consisting of a higher fatty acid having 10 or more carbon atoms or salts thereof, a wax, or a mixture of a higher fatty acid having 10 or more carbon atoms or salts thereof and a wax, said coupler containing treating agent being substantially incapable of forming a dyestuff with said diazonium salt in the absence of an alkaline developing environment

2. The solid treating agent of claim 1 wherein said thermovolatile or thermosublimable coupler is pyrogallol, resorcinol, resorcinol monoglycol ether, 2,3-dihydroxynaphthalene, 1,6-dihydroxynaphthalene, 1,7-dihydroxynaphthalene, 2,7-dihydroxynaphthalene, metaaminophenol, dimethyl-m-aminophenol, 1-phenyl-3-methylpyrazolone(5), 1-phenyl-3-carboxypyrazolone, acetoacetic acid anilide, 5-hydroxy-2-hydroxymethyl-γ-pyrone, 1-(3′-chlorophenyl)-3-methylpyrazolone(5), 1-(p-toluyl)-3-methylpyrazolone(5), 4-chloro-resorcin, 4-bromo-resorcin or o-amino-phenol.

3. The solid treating agent of claim 1 in which the coloring material is present.

4. The solid treating agent of claim 1, which consists essentially of about 50% by weight of the thermovolatile or thermosublimable coupler, about 10 to 20% by weight of the extender, and about 30 to 40% by weight of the solid dispersion medium.

5. The solid treating agent of claim 1 which consists essentially of a homogeneous mixture of a red color forming composition of the following ingredients:

| | Parts by Weight |
|---|---|
| 1-phenyl-3-methyl-pyrazolone | 50 |
| Palmitic acid | 30 |
| Talc | 15 |
| $SiO_2$ | 5. |

6. The solid treating agent of claim 1 which consists essentially of a homogeneous mixture of a yellow color forming composition of the following ingredients:

| | Parts by Weight |
|---|---|
| Acetoacetic acid anilide | 50 |
| Stearic acid | 30 |
| Paraffin | 10 |
| Terra alba | 5 |
| $SiO_2$ | 5. |

7. The solid treating agent of claim 1 which consists essentially of a homogeneous mixture of a blue color forming composition of the following ingredients:

| | |
|---|---|
| 2,3-dihydroxynaphthalene | 50 |
| Lauric acid | 30 |
| Talc | 10 |
| Beeswax | 10. |

* * * * *

UNITED STATES PATENT AND TRADEMARK OFFICE

CERTIFICATE OF CORRECTION

PATENT NO. : 3,976,488

DATED : August 24, 1976

INVENTOR(S) : NIHYAKUMEN, ET AL.

It is certified that error appears in the above-identified patent and that said Letters Patent are hereby corrected as shown below:

Claim 1, last line, after "environment" insert -- . --

Claim 7, line 4, right-hand column, insert the heading:

-- Parts by Weight --

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademark*